US011417949B2

(12) United States Patent
Sudo et al.

(10) Patent No.: US 11,417,949 B2
(45) Date of Patent: Aug. 16, 2022

(54) ANTENNA MODULE AND COMMUNICATION DEVICE HAVING SAME MOUNTED THEREIN

(71) Applicant: Murata Manufacturing Co., Ltd., Kyoto (JP)

(72) Inventors: Kaoru Sudo, Kyoto (JP); Kengo Onaka, Kyoto (JP); Hirotsugu Mori, Kyoto (JP); Shigeru Tago, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/076,843

(22) Filed: Oct. 22, 2020

(65) Prior Publication Data

US 2021/0044007 A1 Feb. 11, 2021

Related U.S. Application Data

(63) Continuation of application No. PCT/JP2019/011068, filed on Mar. 18, 2019.

(30) Foreign Application Priority Data

Apr. 25, 2018 (JP) ..... JP2018-084355
Oct. 15, 2018 (JP) ..... JP2018-194113

(51) Int. Cl.
*H01Q 1/24* (2006.01)
*H01Q 1/38* (2006.01)
(Continued)

(52) U.S. Cl.
CPC ..... *H01Q 1/38* (2013.01); *H01Q 1/243* (2013.01); *H01Q 1/48* (2013.01); *H01Q 9/045* (2013.01); *H01Q 21/065* (2013.01)

(58) Field of Classification Search
CPC ..... H01Q 1/38; H01Q 1/48; H01Q 1/243; H01Q 1/2216; H01Q 5/378; H01Q 9/0407; H01Q 9/045; H01Q 9/0428
See application file for complete search history.

(56) References Cited

U.S. PATENT DOCUMENTS 6,121,931 A 9/2000 Levi
7,639,183 B2 * 12/2009 Teshirogi ..... H01Q 13/06 343/895
(Continued)

FOREIGN PATENT DOCUMENTS

JP H05-102721 A 4/1993
JP H0614592 B2 2/1994
(Continued)

OTHER PUBLICATIONS

Japanese Office action for Application No. 2020-516103 dated Aug. 3, 2021.
(Continued)

*Primary Examiner* — Tung X Le
(74) *Attorney, Agent, or Firm* — Pearne & Gordon LLP

(57) ABSTRACT

This antenna module (100) includes a dielectric substrate (130) and radiation electrodes (121) and a ground electrode (GND) that are arranged on or in the dielectric substrate (130). A plurality of openings (122) are formed in at least one electrode out of the radiation electrode (121) and the ground electrode (GND), the plurality of openings (122) penetrating through the electrode but not penetrating through the dielectric substrate (130).

19 Claims, 10 Drawing Sheets

(51) Int. Cl.

| | |
|---|---|
| ***H01Q 1/48*** | (2006.01) |
| ***H01Q 9/04*** | (2006.01) |
| *H01Q 21/06* | (2006.01) |

(56) References Cited

U.S. PATENT DOCUMENTS

| | | | | |
|---|---|---|---|---|
| 7,907,092 | B2 * | 3/2011 | Soler Castany | H01Q 9/40 343/700 MS |
| 2005/0146467 | A1 * | 7/2005 | He | H01Q 9/0407 343/700 MS |
| 2009/0153404 | A1 * | 6/2009 | Ryou | H01Q 5/378 343/700 MS |
| 2014/0247194 | A1 * | 9/2014 | Durnan | H01Q 3/26 343/867 |
| 2015/0070235 | A1 * | 3/2015 | Kashino | H01Q 1/38 343/819 |
| 2016/0190696 | A1 * | 6/2016 | Preradovic | H01Q 9/0428 343/700 MS |
| 2019/0157747 | A1 * | 5/2019 | Su | H01Q 1/273 |

FOREIGN PATENT DOCUMENTS

| | | | |
|---|---|---|---|
| JP | 200049526 | A | 2/2000 |
| JP | 2000-514614 | A | 10/2000 |
| JP | 3248277 | B2 | 1/2002 |
| JP | 2004304226 | A | 10/2004 |
| JP | 2010187353 | A | 8/2010 |
| JP | 2018026717 | A | 2/2018 |

OTHER PUBLICATIONS

International Search Report issued in Application No. PCT/JP2019/011068, dated May 14, 2019.

Written Opinion issued in Application No. PCT/JP2019/011068, dated May 14, 2019.

* cited by examiner

FIG. 8A
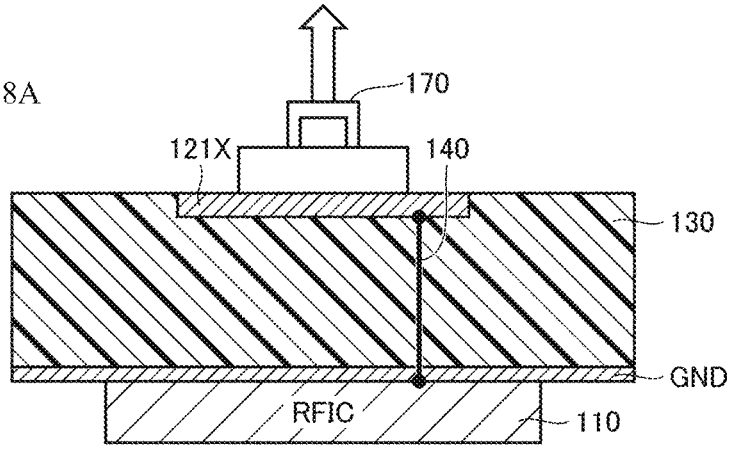
FIG. 8B
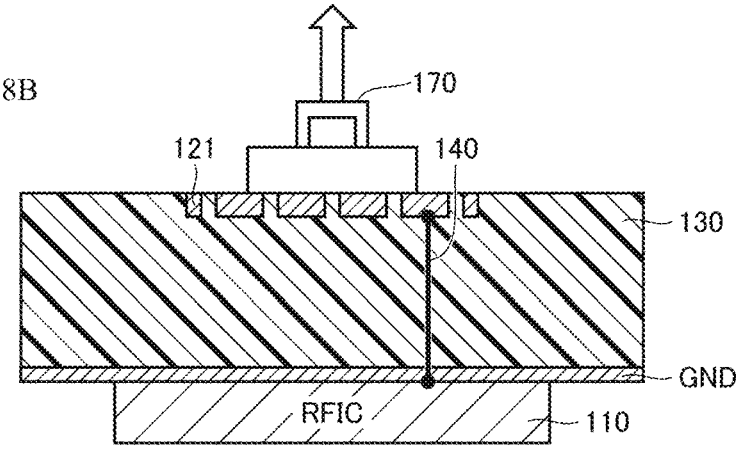
FIG.9
| | WITHOUT OPENINGS (N) | WITH OPENINGS (N) | PERCENTAGE INCREASE |
|---|---|---|---|
| SAMPLE 1 | 29.0 | 47.0 | |
| SAMPLE 2 | 27.5 | 43.0 | |
| SAMPLE 3 | 24.0 | 33.0 | |
| AVERAGE | 26.8 | 41.0 | 153% |

ANTENNA MODULE AND COMMUNICATION DEVICE HAVING SAME MOUNTED THEREIN

CROSS REFERENCE TO RELATED APPLICATION

This is a continuation of International Application No. PCT/JP2019/011068 filed on Mar. 18, 2019 which claims priority from Japanese Patent Application No. 2018-084355 filed on Apr. 25, 2018 and Japanese Patent Application No. 2018-194113 dated Oct. 15, 2018. The contents of these applications are incorporated herein by reference in their entireties.

BACKGROUND OF THE DISCLOSURE

Field of the Disclosure

The present disclosure relates to an antenna module and to a communication device having the antenna module mounted therein, and more specifically relates to a structure that improves the adhesion strength between a radiation electrode and a dielectric substrate in an antenna module.

Description of the Related Art

Japanese Patent No. 3248277 (Patent Document 1) discloses an antenna module in which a radiation electrode is arranged on one surface of a substrate and an earth electrode is arranged on the surface of the substrate on the opposite side from the surface on which the radiation electrode is arranged.

Patent Document 1: Japanese Patent No. 3248277

BRIEF SUMMARY OF THE DISCLOSURE

When the antenna module disclosed in Patent Document 1 is manufactured, a method in which the radiation electrode is adhered to the substrate by performing heating and pressing may be employed.

A dielectric material such as a resin is typically used for the substrate on which the radiation electrode is arranged. The heating of such a substrate when adhering the radiation electrode to the substrate causes some of the material contained inside the substrate to be released as a gas to the outside of the substrate.

At this time, the released gas may become trapped at the interface between the radiation electrode and the substrate and small spaces may be formed between the radiation electrode and the substrate. Consequently, the adhesion strength between the radiation electrode and the substrate may be reduced.

An antenna module may be used in a mobile terminal such as a mobile phone or a smartphone, and in such a case, the radiation electrode would be adhered to a resin part of the casing of the mobile terminal using an adhesive or the like. As a result, a tensile force may act in a direction that would cause the radiation electrode and the substrate to peel away from each other during use of the mobile terminal.

If the adhesion strength between the radiation electrode and the substrate is reduced due to the gas being generated from the substrate as described above, the radiation electrode may become detached from the substrate resulting in the degradation of the antenna characteristics.

The present disclosure was made in order to solve the above-described problem and it is an object thereof to suppress the reduction of the adhesion strength between an electrode arranged on a substrate and the substrate.

An antenna module according to a certain aspect of this disclosure includes a dielectric substrate and a radiation electrode and a ground electrode that are arranged on or in the dielectric substrate. A plurality of openings are formed in at least one electrode out of the radiation electrode and the ground electrode, the plurality of openings penetrating through the electrode but not penetrating through the dielectric substrate.

In the antenna module according to this disclosure, the plurality of openings (through holes) are formed in at least one electrode out of the radiation electrode and the ground electrode. The gas generated from the substrate during the manufacture and so on in the part of the substrate where the electrode is arranged passes through the openings and is released to the outside of the antenna module. Consequently, it is possible to suppress the reduction of the adhesion strength between the electrode and the substrate caused by the gas remaining between the electrode and the substrate.

Each of FIGS. 8A and 8B is a diagram for explaining an overview of an experiment for verifying adhesion strength.

FIG. 9 is a diagram illustrating an example of results of the verification experiment.

Figure 10:
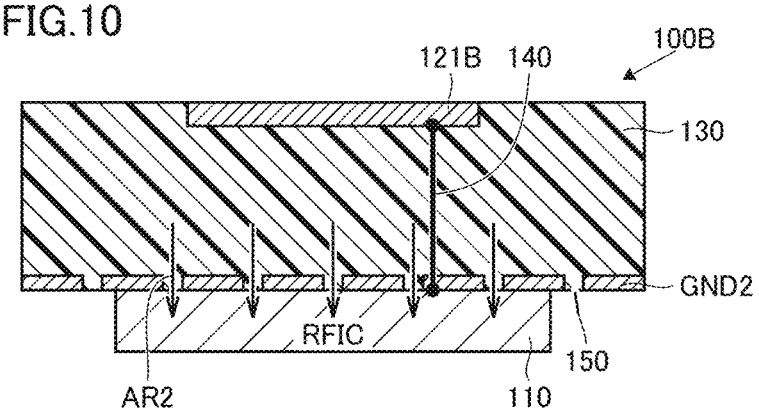

FIG. 10 is a sectional view of an antenna module according to modification 2.

Figure 11:
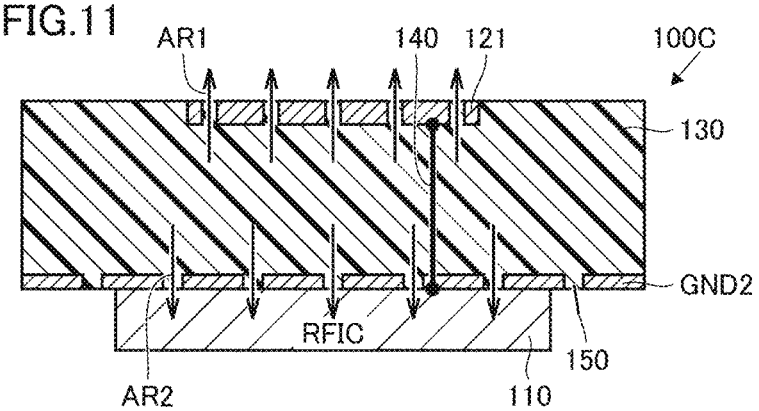

FIG. 11 is a sectional view of an antenna module according to modification 3.

Figure 12:
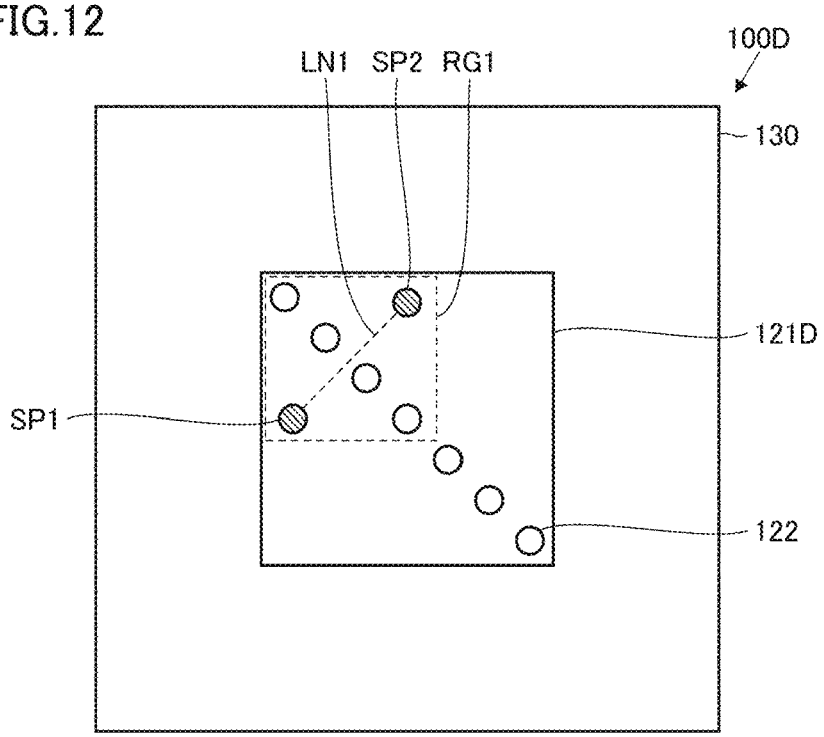

FIG. 12 is a plan view of an antenna module according to embodiment 2.

Figure 13:
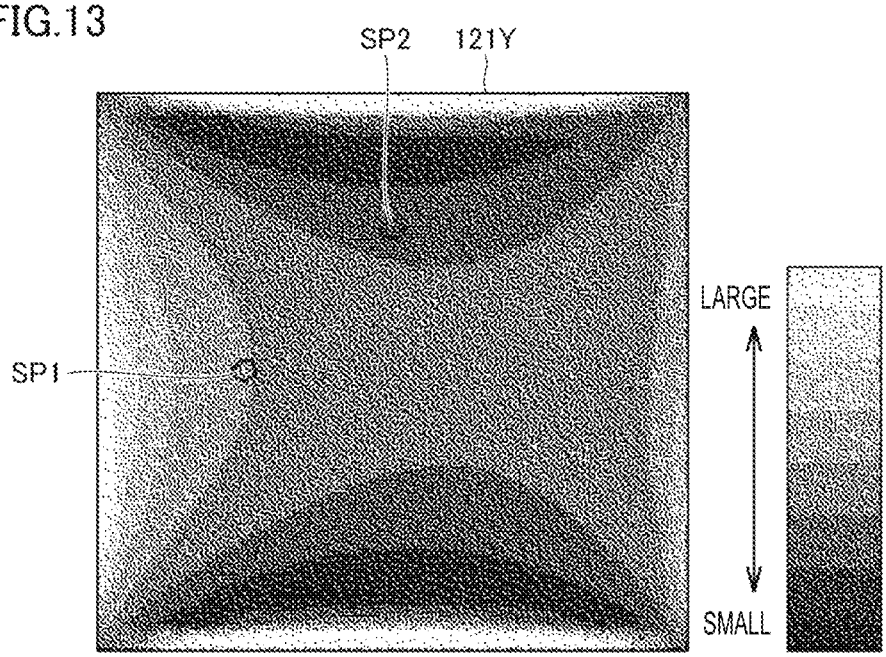

FIG. 13 is a diagram illustrating an example of the current distribution of a radiation electrode in an antenna module of a comparative example.

Figure 14:
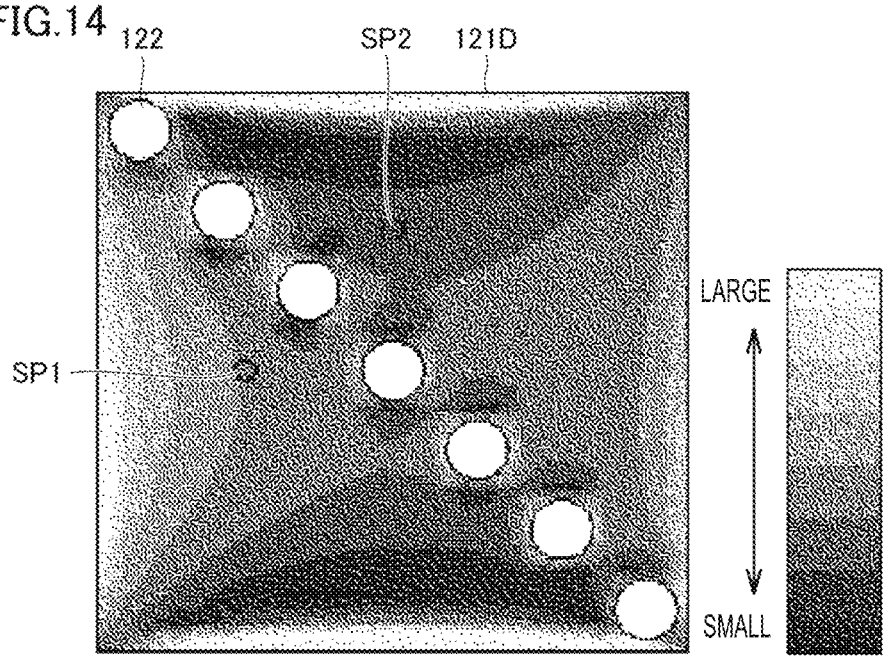

FIG. 14 is a diagram illustrating an example of the current distribution of a radiation electrode in the antenna module in FIG. 11.

Figure 15:
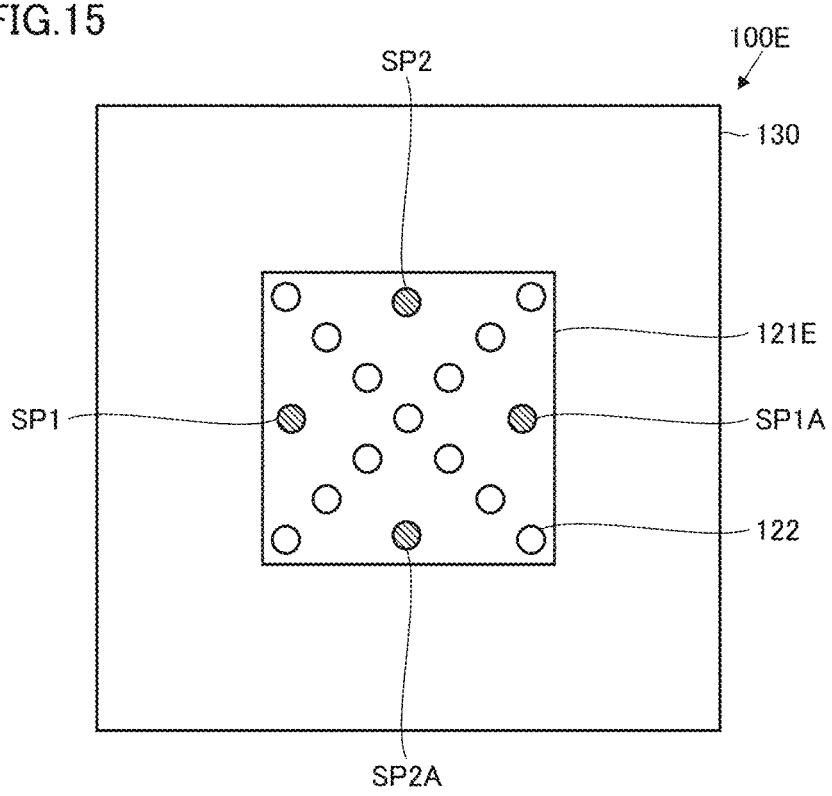

FIG. 15 is a plan view of an antenna module according to modification 4.

Figure 16:
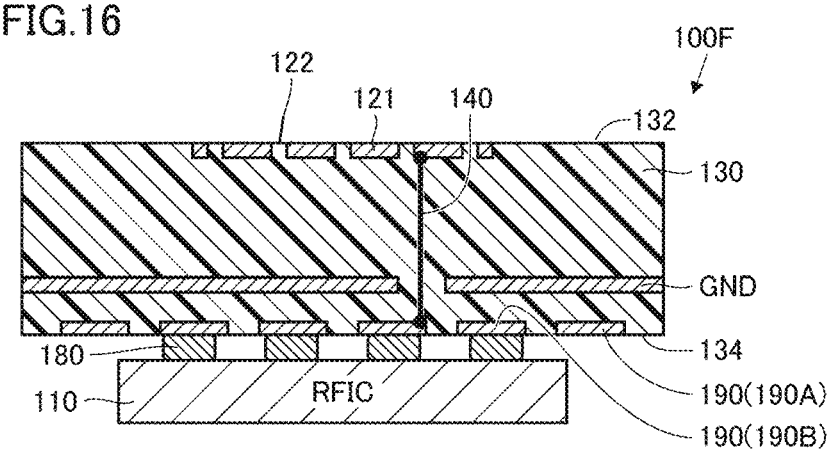

FIG. 16 is a sectional view of an antenna module according to embodiment 3.

Figure 17:
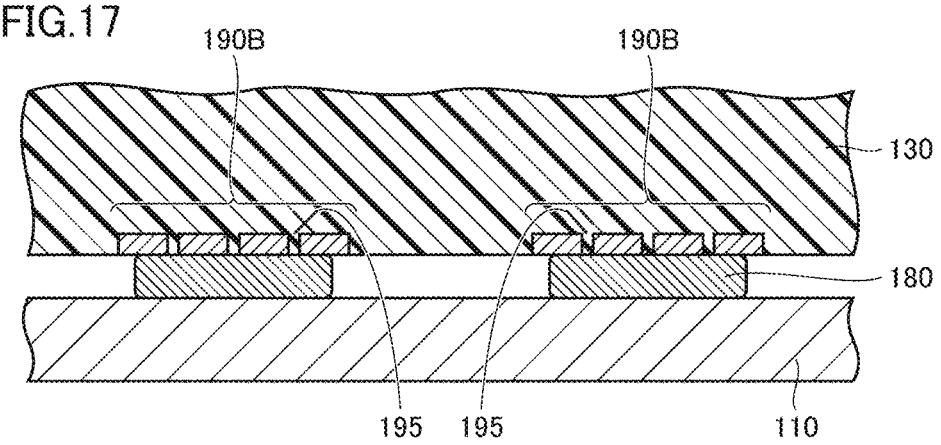

FIG. 17 is an enlarged view of connection parts between an RFIC and electrode pads in FIG. 16.

Figure 18:
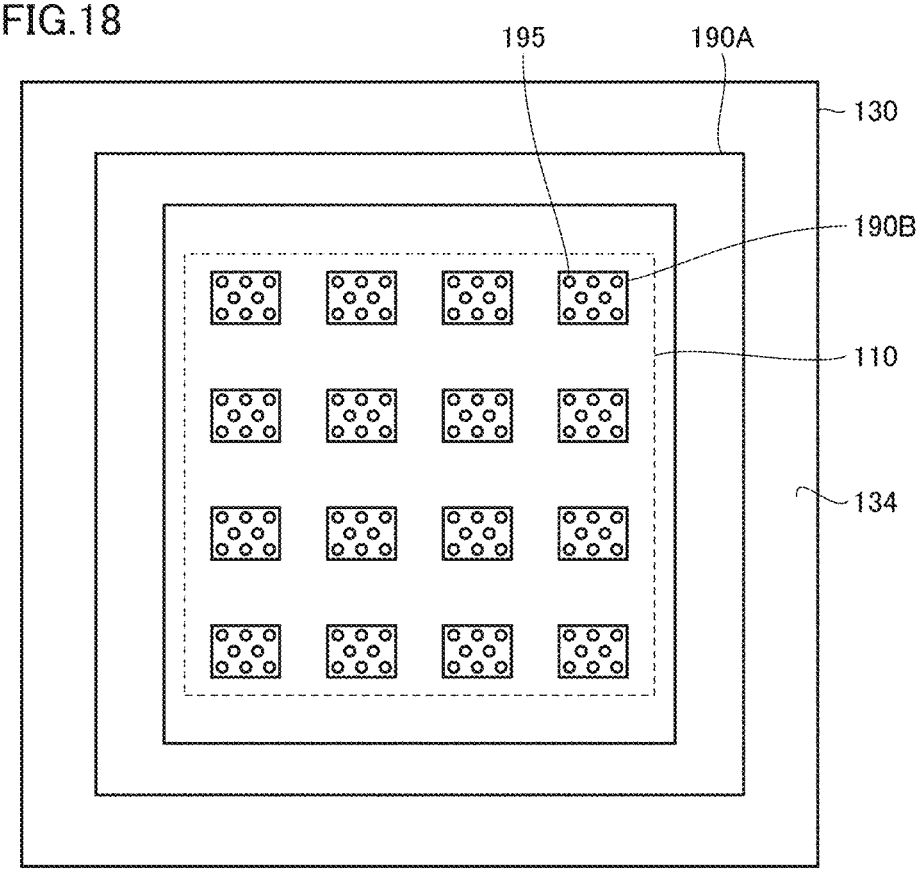

FIG. 18 is a plan view in which the antenna module in FIG. 16 is viewed from a second surface side.

Each of FIGS. 19A, 19B, 19C and 19D is a diagram for explaining an example of a process of manufacturing an antenna module.

Figure 20:
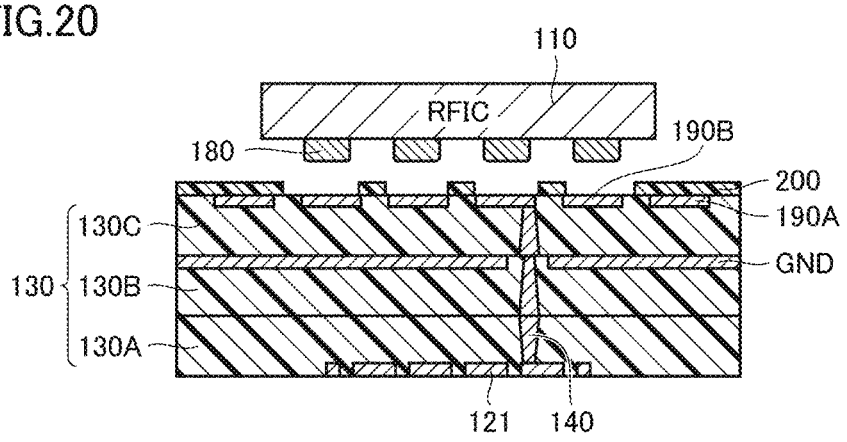

FIG. 20 is a sectional view of an antenna module that has been provided with a protective film.

Figure 21:
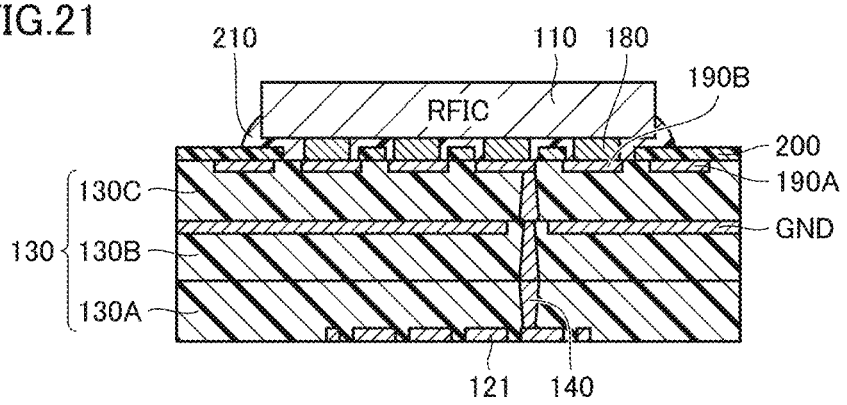

FIG. 21 is a sectional view of an antenna module that has been subjected to an underfill sealing process.

Figure 22:
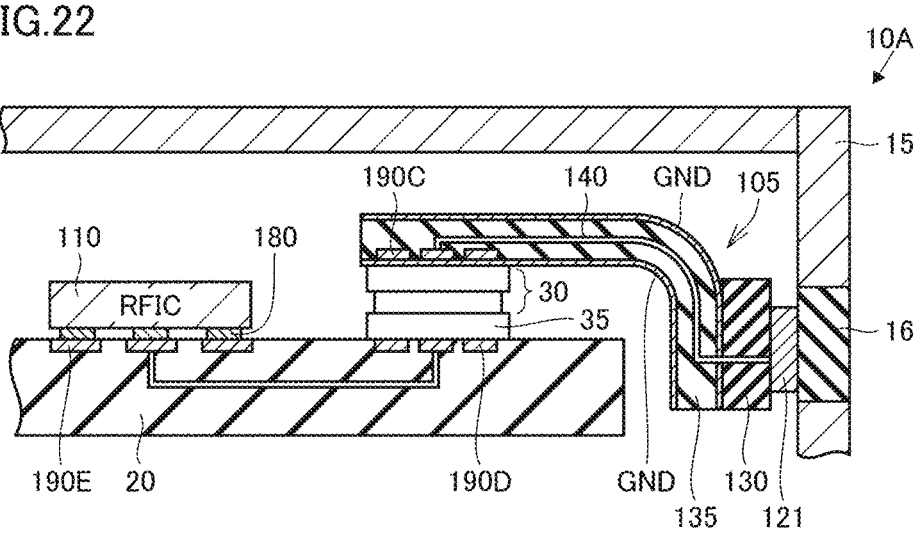

FIG. 22 is a diagram for explaining application to a flexible substrate.

DETAILED DESCRIPTION OF THE DISCLOSURE

Hereafter, embodiments of the present disclosure will be described in detail while referring to the drawings. In the figures, the same symbols denote identical or corresponding portions and repeated description thereof is omitted.

Embodiment 1

Basic Configuration of Communication Device

Figure 1:
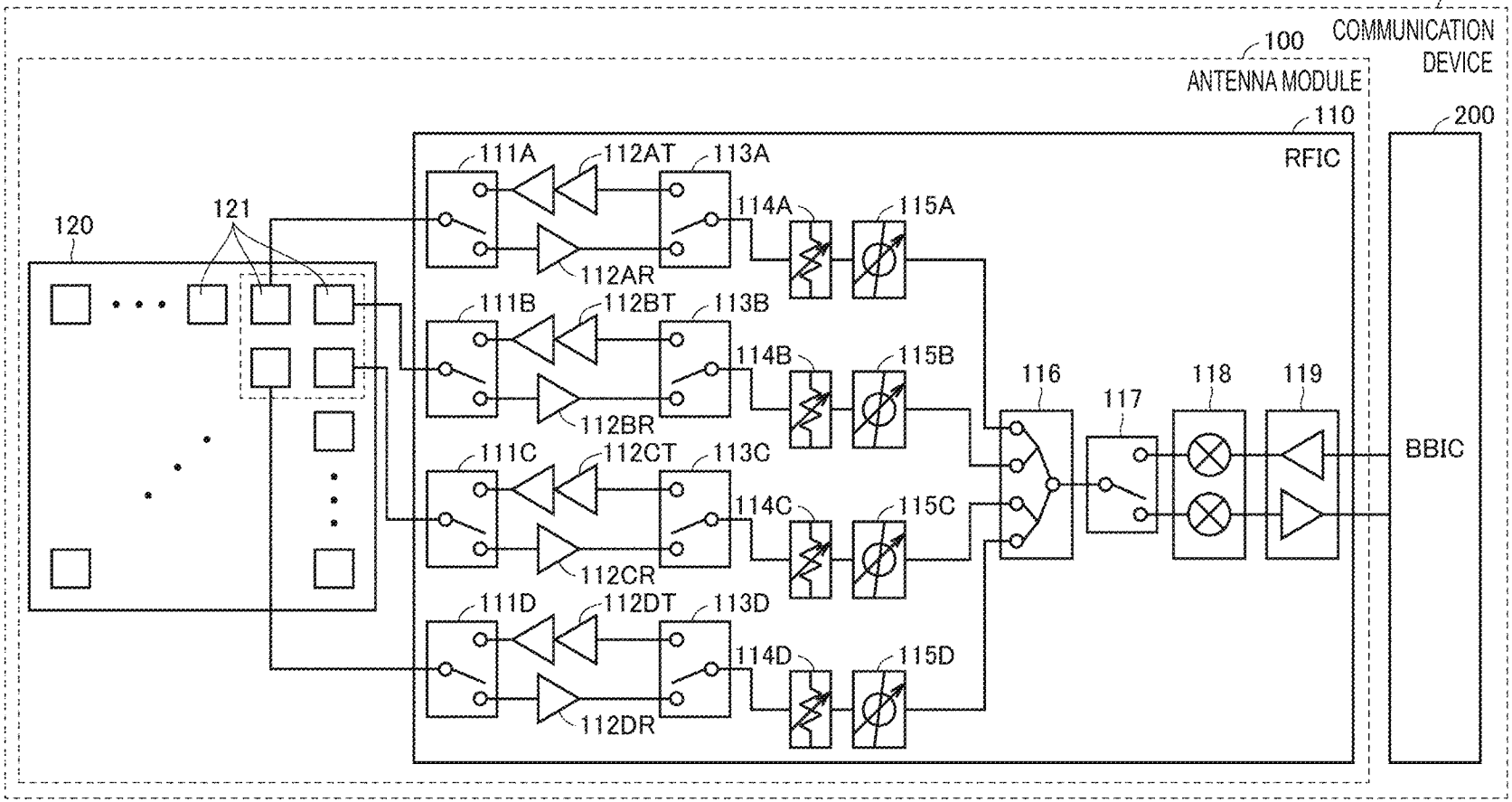
FIG. 1 is a block diagram of a communication device in which an antenna module according to an embodiment is used.

FIG. 1 is a block diagram of an example of a communication device 10 in which an antenna module 100 according to this embodiment 1 is used. The communication device 10 is, for example, a mobile terminal such as a mobile phone, a smart phone, or a tablet, a personal computer having a communication function, or the like.

Referring to FIG. 1, the communication device 10 includes the antenna module 100 and a BBIC 200 that forms a baseband signal processing circuit. The antenna module 100 includes an RFIC 110, which is an example of a feeder circuit, and an antenna array 120. The communication device 10 up-converts a signal transmitted to the antenna module 100 from the BBIC 200 into a radio-frequency signal and radiates the radio-frequency signal from the antenna array 120 and the communication device 10 down-converts a radio-frequency signal received by the antenna array 120 and subjects the down-converted signal to signal processing using the BBIC 200.

In FIG. 1, for simplicity of explanation, only the configurations corresponding to four radiation electrodes 121 among a plurality of radiation electrodes 121 forming the antenna array 120 are illustrated and the configurations corresponding to the rest of the radiation electrodes 121, which have the same configurations, are omitted.

The RFIC 110 includes switches 111A to 111D, 113A to 113D, and 117, power amplifiers 112AT to 112DT, low-noise amplifiers 112AR to 112DR, attenuators 114A to 114D, phase shifters 115A to 115D, a signal multiplexer/demultiplexer 116, a mixer 118, and an amplification circuit 119.

In the case where a radio-frequency signal is to be transmitted, the switches 111A to 111D and 113A to 113D are switched to the power amplifiers 112AT to 112DT, and the switch 117 is connected to a transmission-side amplifier of the amplification circuit 119. In the case where a radio-frequency signal is to be received, the switches 111A to 111D and 113A to 113D are switched to the low-noise amplifiers 112AR to 112DR, and the switch 117 is connected to a reception-side amplifier of the amplification circuit 119.

A signal transmitted from the BBIC 200 is amplified by the amplification circuit 119 and up-converted by the mixer 118. A transmission signal, which is the up-converted radio-frequency signal, is divided into four signals by the signal multiplexer/demultiplexer 116, and the four signals pass along four signal paths and are respectively supplied to different radiation electrodes 121. At this time, the directivity of the antenna array 120 can be adjusted by individually adjusting the phases of the phase shifters 115A to 115D arranged along the respective signal paths.

Reception signals, which are radio-frequency signals received by the radiation electrodes 121, pass along four different signal paths and are multiplexed by the signal multiplexer/demultiplexer 116. The multiplexed reception signal is down-converted by the mixer 118, amplified by the amplification circuit 119, and transmitted to the BBIC 200.

The RFIC 110 is, for example, formed as a single chip integrated circuit component including the above-described circuit configuration. Alternatively, devices (switches, power amplifiers, low-noise amplifiers, attenuators, and phase shifters) of the RFIC 110 that correspond to the individual radiation electrodes 121 may be formed as a single integrated chip component for each corresponding radiation electrode 121.

Structure of Antenna Module

Figure 2:
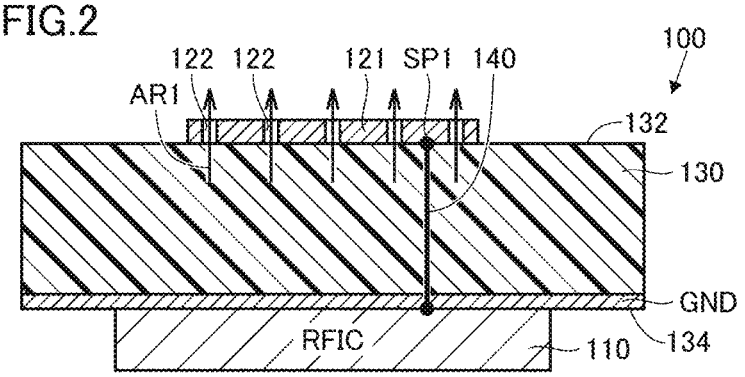
FIG. 2 is a sectional view of an antenna module according to embodiment 1.

FIG. 2 is a sectional view of the antenna module 100 according to embodiment 1. Referring to FIG. 2, the antenna module 100 includes a dielectric substrate 130, a transmission line 140, and a ground electrode GND in addition to the radiation electrodes 121 and the RFIC 110. In FIG. 2, for simplicity of explanation, a case where only one radiation electrode 121 is arranged is described, but a plurality of radiation electrodes 121 may be arranged.

The dielectric substrate 130 is, for example, a substrate in which a resin such as epoxy or polyimide is formed in a multilayer structure. In addition, the dielectric substrate 130 may be formed using a liquid crystal polymer (LCP) or a fluorine-based resin having a low dielectric constant. The dielectric substrate 130 may be molded by sequentially stacking resin layers and metal layers, or, for example, may be molded in a single operation by heating and pressure bonding together a plurality of thermoplastic resin layers each having a metal film formed on one surface thereof.

The radiation electrode 121 is arranged on a first surface 132 of the dielectric substrate 130. A plurality of openings 122, which penetrate through the electrode, are formed in the radiation electrode 121. Through holes are not formed in the dielectric substrate 130 at positions corresponding to the plurality of openings 122. In other words, the dielectric substrate 130 is exposed through the radiation electrode 121 as a result of the plurality of openings 122 being formed. The ground electrode GND is arranged on a second surface 134 of the dielectric substrate 130, which is on the opposite side from the first surface 132 of the dielectric substrate 130. An example is illustrated in FIG. 2 in which the ground electrode GND is arranged on the outermost surface of the dielectric substrate 130, but the ground electrode GND may instead be formed on an inner layer of the dielectric substrate 130. In the case where the ground electrode GND is arranged on the outermost surface of the dielectric substrate 130, the surface of the ground electrode GND is covered with a resist or a coverlay, which is a thin-film dielectric layer. Although not illustrated in FIG. 2, the RFIC 110 is mounted on electrode pads (mounting electrodes) formed on the second surface 134 of the dielectric substrate 130 using connection members such as solder bumps, and a through hole, through which the transmission line 140 extends, is formed in the ground electrode GND.

In this case, the plurality of openings 122 penetrate through the radiation electrode 121, but do not penetrate through the dielectric substrate 130. Therefore, the antenna module 100 is stronger compared with a configuration where a plurality of openings are formed that penetrate through the dielectric substrate 130 and in addition is able to suppress disturbance of the antenna characteristics caused by variations in dielectric constant.

Figure 3:
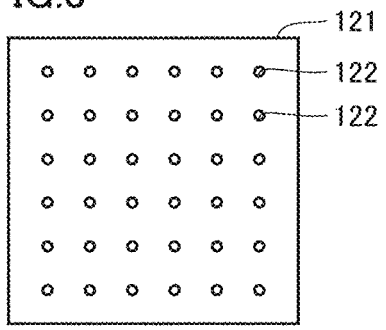
FIG. 3 is a diagram for explaining an example of the arrangement of openings in the radiation electrode.

FIG. 3 is a plan view in which the radiation electrode 121 is viewed in a direction normal thereto and illustrates an example arrangement of the plurality of openings 122. In FIG. 3, the plurality of openings 122 are formed uniformly and evenly spaced over the entire surface of the radiation electrode 121. As an example, openings 122 having a diameter of 40 μm are formed at a pitch spacing of 250 μm. The whole peripheries of the openings 122 are surrounded by the radiation electrode 121 in a plan view of the radiation electrode 121.

Referring again to FIG. 2, the transmission line 140 is connected between the RFIC 110 and the radiation electrode 121 and transmits radio-frequency power supplied from the RFIC 110 to the radiation electrode 121. The transmission line 140 is formed of a combination of wiring patterns, which are electrodes formed on inner layers of the dielectric substrate 130, and vias, which are electrodes connected between layers of the dielectric substrate 130. In addition, as illustrated in FIG. 2, the transmission line 140 may be formed of just vias. The transmission line 140 may have a configuration in which part of the transmission line 140 is physically disconnected and capacitive coupling is used to transmit radio-frequency power. The transmission line 140 is electrically connected to the radiation electrode 121 at a feed point SP1.

Figure 4:
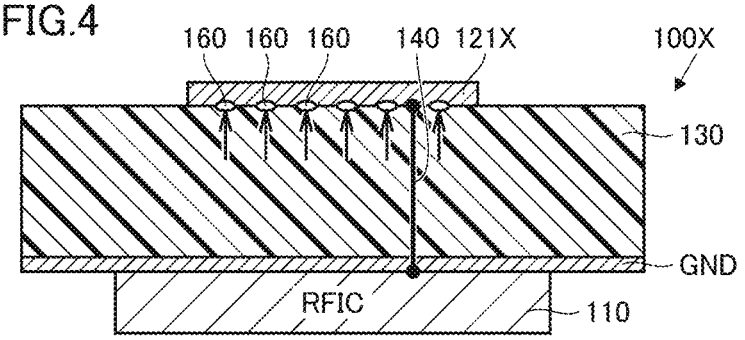
FIG. 4 is a sectional view of an antenna module of a comparative example.

FIG. 4 is a sectional view of an antenna module 100X of a comparative example. Openings such as those in the radiation electrode 121 in FIG. 2 are not formed in a radiation electrode 121X of the antenna module 100X.

When manufacturing the antenna modules illustrated in FIGS. 2 and 4, a method in which the radiation electrode is adhered to the dielectric substrate by performing heating and pressing may be used. At this time, gaseous components such as the air trapped inside the dielectric substrate or some of the material of the dielectric substrate that has transformed into a gas due to being heated are released to the outside of the substrate.

In a configuration like that of the antenna module 100X of the comparative example, the released gas may become trapped at the interface between the radiation electrode 121X and the dielectric substrate 130, and small spaces 160 may be formed between the radiation electrode 121X and the dielectric substrate 130. As a result, the adhesion strength between the radiation electrode 121X and the dielectric substrate 130 may be reduced.

In contrast, in the antenna module 100 of embodiment 1, since the plurality of openings 122 are formed in the radiation electrode 121, the gas generated from the dielectric substrate 130 is easily released to the outside through the openings 122 as indicated by the arrows AR1 in FIG. 2. Consequently, since spaces like those in FIG. 3 are unlikely to be formed between the radiation electrode 121 and the dielectric substrate 130, the reduction of the adhesion strength between the radiation electrode 121 and the dielectric substrate 130 can be suppressed.

Modification 1

Figure 5:
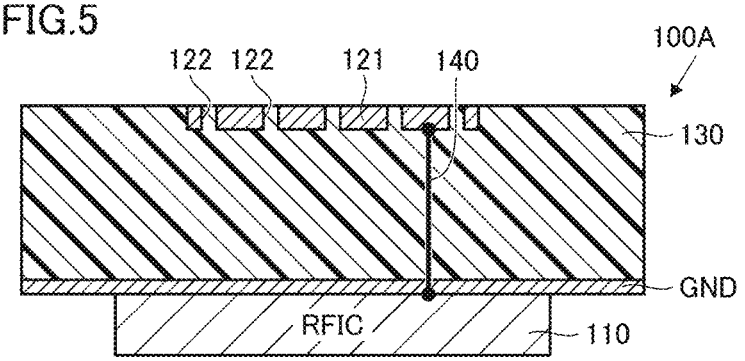
FIG. 5 is a sectional view of an antenna module according to modification 1.

FIG. 5 is a sectional view of an antenna module 100A of modification 1. The arrangement of the radiation electrode 121 in modification 1 is different from that in FIG. 2. Specifically, the radiation electrode 121 is arranged so as to be embedded inside the dielectric substrate 130 rather than being arranged on the surface of the dielectric substrate 130. In this case, the insides of the plurality of openings 122 formed in the radiation electrode 121 are filled with the dielectric material of the dielectric substrate 130. Therefore, the contact area between the radiation electrode 121 and the dielectric substrate 130 is increased compared with a radiation electrode in which the plurality of openings 122 are not formed and thus the adhesion strength can be further increased.

Figure 6:
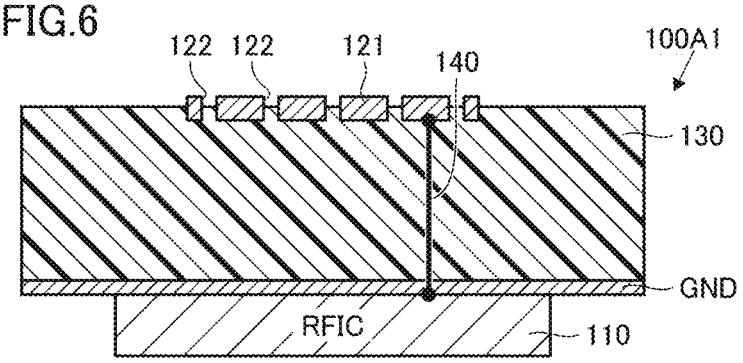
FIG. 6 is a sectional view of another example of an antenna module according to modification 1.
Figure 7:
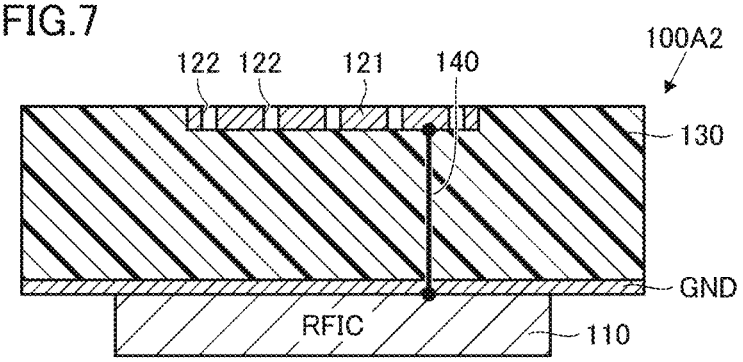
FIG. 7 is a sectional view of yet another example of an antenna module according to modification 1.

Note that the insides of the openings 122 do not necessarily have to be filled with the dielectric material, as illustrated in FIGS. 6 and 7. Specifically, only part of the radiation electrode 121 may be embedded in the dielectric substrate 130 like in the case of an antenna module 100A1 in FIG. 6. In addition, the entire radiation electrode 121 may be embedded in the dielectric substrate 130, but at least part of each opening 122 may not be filled with the dielectric material like in the case of an antenna module 100A2 in FIG. 7. In these cases, as well, the contact area between the outer peripheral surface of the radiation electrode 121 and the inner wall of the recess in the dielectric substrate 130 and the contact areas between the inner walls of the openings 122 and the dielectric substrate 130 are increased, thus increasing the adhesion strength compared to the case in FIG. 2.

Verification Experiment

The inventors carried out an experiment illustrated in FIGS. 8A and 8B in order to verify the difference in the adhesion strength resulting from the presence or absence of openings. Specifically, for an antenna module having a radiation electrode in which openings were not formed (FIG. 8B) and an antenna module having a radiation electrode in which openings were formed (FIG. 8B), a metal fitting 170 was attached to the radiation electrode using solder and the metal fitting 170 was pulled in a direction normal to the antenna module, and the tensile forces acting when the radiation electrode was peeled off were compared. The radiation electrode was formed using 12 μm copper and for the case in FIG. 8B, openings having a diameter of 40 μm were formed at a pitch of 250 μm.

FIG. 9 illustrates the results obtained when the experiment was carried out using the above method for three samples of each type of antenna module. As illustrated in FIG. 9, for all the samples, it was confirmed that the tensile force was higher for the samples in which openings had been formed than in the samples in which openings had not been formed and that the strength was around 150% on average.

Modifications 2 and 3

FIG. 10 is a sectional view of an antenna module 100B according to modification 2. In modification 2, a plurality of openings 150 are formed in a ground electrode GND2 instead of in a radiation electrode 121B.

The gas released from the dielectric substrate is also released from the ground electrode side of the dielectric substrate not only from the radiation electrode side of the dielectric substrate. Therefore, the gas released from the dielectric substrate may also become trapped between the ground electrode and the dielectric substrate, and this may result in the adhesion strength between the ground electrode and the dielectric substrate being reduced.

As a result of forming the plurality of openings 150 in the ground electrode GND2, as illustrated in FIG. 10, the gas from the dielectric substrate is released to the outside through the openings 150 (the arrows AR2 in FIG. 10), and therefore the adhesion strength between the ground electrode GND2 and the dielectric substrate 130 can be increased.

FIG. 11 is a sectional view of an antenna module 100C according to modification 3. In modification 3, a plurality of openings are formed in both the radiation electrode 121 and the ground electrode GND2. In modification 3, the adhesion strength between the radiation electrode 121 and the dielectric substrate 130 and the adhesion strength between the ground electrode GND2 and the dielectric substrate 130 can be increased.

Embodiment 2

In embodiment 2, a case in which radio-frequency power is supplied to one radiation electrode via a plurality of feed points will be described.

FIG. 12 is a plan view of an antenna module 100D according to embodiment 2. A square-shaped radiation electrode 121D is used in the antenna module 100D. The radiation electrode 121D is supplied with radio-frequency power via two feed points SP1 and SP2 and is configured so as to be capable of radiating radio-frequency signals of two polarizations. The feed point SP2 is located at a position obtained by rotating the position of the feed point SP1 by 90° around the intersection of the diagonal lines of the radiation electrode 121D.

In the antenna module 100D, a plurality of openings 122 are formed along a diagonal line of the radiation electrode 121D that intersects with a line LN1 connecting the feed point SP1 and the feed point SP2. In other words, the plurality of openings 122 are formed within a prescribed region RG1 that includes at least the line LN1 connecting the feed point SP1 and the feed point SP2.

In an antenna module capable of radiating radio-frequency signals of two polarizations, as illustrated in FIG. 12, it is important to ensure the isolation between the two polarizations. In the antenna module 100D illustrated in FIG. 12, since the plurality of openings 122 are formed between the two feed points SP1 and SP2 of the radiation electrode 121D, the electrical resistance between the feed point SP1 and the feed point SP2 is substantially increased compared with the case where no openings are formed. Therefore, the isolation between the two feed points SP1 and SP2 can be improved.

FIG. 13 illustrates the current distribution of a radiation electrode 121Y of an antenna module of a comparative example in which a plurality of openings are not formed, and FIG. 14 illustrates the current distribution of the radiation electrode 121D of the antenna module 100D in FIG. 12. In FIGS. 13 and 14, the magnitudes of values of the current distribution are illustrated using shading, and the darker the shading, the smaller the value of the current distribution.

Comparing FIGS. 13 and 14, it is clear that the parts around the peripheries of the openings 122 are darker meaning that there are parts where the current distribution is smaller. In other words, the current flowing from the feed point SP1 to the feed point SP2 and the current flowing from the feed point SP2 to the feed point SP1 are reduced as a result of the openings 122 being formed, and therefore it is clear that the isolation between the feed point SP1 and the feed point SP2 is improved.

Thus, as a result of openings being formed inside a prescribed region including a line connecting the two feed points of the radiation electrode to each other in a two polarization type antenna module, the adhesion strength between the radiation electrode and the dielectric substrate is increased due to the gas released from the dielectric substrate to the outside, and the isolation between the two feed points can be improved.

In the example in FIG. 12, the plurality of openings are formed along a diagonal line of the radiation electrode, but so long as the positions at which the openings are formed lie within a prescribed region that includes a line connecting the two feed points, the positions are not limited to this example. For example, the plurality of openings may be formed uniformly and evenly spaced across the entire radiation electrode, as illustrated in FIG. 3 of embodiment 1.

A case in which the openings are formed in the radiation electrode has been described in the example in FIG. 12, but the openings may instead be formed in the ground electrode. In a plan view of the antenna module, if the openings are formed in the ground electrode inside a prescribed region including a line connecting the positions corresponding to the two feed points of the radiation electrode, the isolation between the feed points can be improved.

The antenna functions as an antenna as a result of electromagnetic coupling between the radiation electrode and the ground electrode. The interference between the electromagnetic field of one polarization and the electromagnetic field of the other polarization is reduced as a result of forming the openings on the ground electrode side, and this means that the isolation between the two polarizations can be improved.

Modification 4

FIG. 15 is a plan view of an antenna module 100E in which radio-frequency power is supplied to four feed points SP1, SP1A, SP2, and SP2A. Referring to FIG. 15, the feed point SP1 and the feed point SP1A are arranged at positions having point symmetry about an intersection between the diagonal lines of a radiation electrode 121E. Similarly, the feed point SP2 and the feed point SP2A are also arranged at positions having point symmetry about the intersection between the diagonal lines of the radiation electrode 121E.

The openings 122 are formed along the diagonal lines of the radiation electrode 121E. In other words, the openings 122 are formed in a prescribed region including lines that connect each pair of feed points. Thus, the isolation between the feed points can be improved.

Radio-frequency powers having opposite phases from each other are preferably supplied to the feed point SP1 and the feed point SP1A, and radio-frequency powers having opposite phases from each other are preferably supplied to the feed point SP2 and the feed point SP2A. As a result, the cross-polarization generated from a transmission line connected to the feed point SP1 and the cross-polarization generated from a transmission line connected to the feed point SP1A cancel each other out, and similarly, the cross-polarization generated from a transmission line connected to the feed point SP2 and the cross-polarization generated from the transmission line connected to the feed point SP2A cancel each other out. Therefore, the cross-polarization discrimination (XPD) can be improved.

In the descriptions given in the above embodiment 1 and embodiment 2, examples have been described in which the radiation electrode has a square shape, but the radiation electrode may instead have a circular shape or a polygonal shape other than a square shape.

In particular, in the case of embodiment 2, the radiation electrode is preferably given a circular shape or a regular polygonal shape in order to secure symmetry between a plurality of polarizations. In this case, the plurality of openings may be formed, for example, along a second line that passes through the center of the radiation electrode and intersects with a first line connecting the two feed points.

Furthermore, the shape of the openings may be a shape other than a circular shape. For example, the openings may be formed to have polygonal shapes or elliptical shapes.

In the above description, the radiation electrode is arranged so as to be exposed from the dielectric substrate, but the radiation electrode does not necessarily have to be exposed from the dielectric substrate and may instead be arranged on an inner layer of the dielectric substrate. Alternatively, the surface of the radiation electrode may be covered with a resist or a coverlay that is a thin-film dielectric layer.

Furthermore, the radiation electrode does not have to directly contact the dielectric substrate, and another member such as an adhesive layer may be arranged between the radiation electrode and the dielectric substrate. It is preferable that a plurality of through holes that communicate with the plurality of openings formed in the radiation electrode be formed in the other member. Alternatively, it is preferable that the other member have gas permeability. This configuration is not limited to the radiation electrode and may also be applied to the ground electrode.

The plurality of openings do not necessarily have to be formed so as to be evenly spaced relative to one another and some of the openings may be formed at a first pitch spacing and at least some of the remaining openings may be formed at a second pitch spacing. For example, in embodiment 2, the spacing between the openings formed outside the prescribed region including a line connecting the two feed points may be made larger than the spacing between the openings formed inside the prescribed region. Furthermore, the shapes of the plurality of openings do not have to be all identical, and the shapes of some of the openings may be different from the shapes of the rest of the openings.

In addition, the mounting position of the RFIC is not limited to the second surface of the dielectric substrate and may instead be formed on the first surface of the dielectric substrate at a different position from the radiation electrode. In this case, a through hole, through which a transmission line extends, does not have to be formed in the ground electrode.

Embodiment 3

In embodiment 3, a configuration is described in which openings are arranged in electrode pads on which the RFIC 110 is mounted.

An antenna module 100F illustrated in FIG. 16 is obtained by arranging the ground electrode GND on an inner layer of the dielectric substrate 130 in the antenna module 100A illustrated in FIG. 5, and FIG. 16 illustrates a mounting part of the RFIC 110 in detail. The description of the elements that are the same as those in FIG. 5 will not be repeated.

Referring to FIG. 16, the ground electrode GND is arranged on a layer between the radiation electrode 121 and the second surface 134 in the dielectric substrate 130. A plurality of conductor patterns 190, which are for realizing the electrical connections to an external device, are arranged on the second surface 134 of the dielectric substrate 130. The conductor patterns 190 include conductor patterns 190B (hereafter also referred to as "electrode pads") to which an external device such as the RFIC 110 is connected and a conductor pattern 190A to which an external device is not connected. As described later in FIGS. 17 and 18, a plurality of openings, which penetrate through the pads, are formed in the electrode pads 190B. The RFIC 110 is electrically connected to the electrode pads 190B using solder bumps 180.

FIG. 17 is an enlarged view of the connection parts between the RFIC 110 and the electrode pads 190B. As described above, a plurality of through holes (openings) 195 are formed in the electrode pads 190B, and the RFIC 110 is connected to the dielectric substrate 130 using the solder bumps 180.

When forming solder connections, heat may act on the regions around the electrode pads 190B of the dielectric substrate 130 due to reflow processing. At this time as well, some of the material remaining inside the substrate may be released as gas. A situation in which the released gas becomes trapped at the interfaces between the electrode pads and the dielectric substrate can be suppressed by providing the plurality of openings 195 in the electrode pads 190B that are connected using solder.

In addition, as illustrated in FIG. 17, it is preferable that the electrode pads 190B be arranged so as to be embedded in the dielectric substrate 130 with the surfaces thereof exposed from the dielectric substrate 130. Often flux is typically used when forming solder connections, but if recesses are generated in parts of the openings 195 when forming the openings 195 in the electrode pads 190B, flux may accumulate in the recesses, and the flux may pop and splash due to the heat applied during the reflow process, and this could be a cause of connection failures. Therefore, the occurrence of connection failures when mounting the RFIC 110 can be suppressed by eliminating recesses in parts of the openings 195 as much as possible by embedding the electrode pads 190B, which are connected using solder, in the dielectric substrate 130.

FIG. 18 is a plan view of the dielectric substrate 130 of the antenna module 100F from the second surface 134 side. The conductor patterns 190 are arranged so as to be exposed at the second surface 134 of the dielectric substrate 130. Here, the part indicated by the dashed line in FIG. 18 is the part where the RFIC 110 is mounted, and a plurality of openings 195 are formed in each electrode pad 190B disposed within the area defined by the dashed line.

On the other hand, the conductor pattern 190A (to which an external device is not connected) that does not function as a mounting electrode is arranged so as to surround the electrode pads 190B. The conductor pattern 190A may be made to function as a shield conductor by connecting the conductor pattern 190A connected to a ground potential.

FIG. 18 illustrates a configuration in which openings are not formed in the conductor pattern 190A, but openings may also be formed in the conductor pattern 190A as with the electrode pads 190B.

(Antenna Module Manufacturing Process)

Next, an antenna module manufacturing process according to this embodiment will be described using FIGS. 19A, 19B, 19C and 19D. In FIGS. 19A, 19B, 19C and 19D, the process of manufacturing the antenna module 100F of embodiment 3 is described as an example. For the antenna module 100F, a manufacturing process is used in which a plurality of thermoplastic resin layers each having a metal film formed on one surface thereof are molded in a single operation by heating and pressure bonding together the thermoplastic resin layers.

Figure 19A:
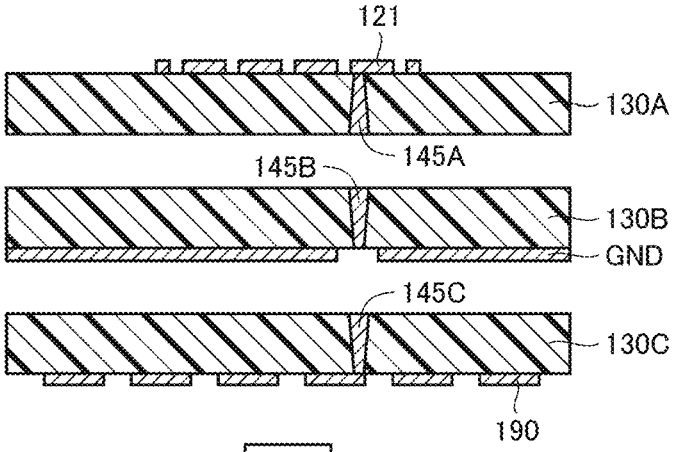

Referring to FIG. 19A, first, a plurality of thermoplastic resin (e.g., LCP resin) layers each having a metal film (e.g., copper foil) formed on one surface thereof are prepared and the metal films of the resin layers are patterned by performing etching or photolithography to form conductor patterns.

In FIG. 19A, a resin layer 130A on which the radiation electrodes 121 are formed, a resin layer 130B on which the ground electrode GND is formed, and a resin layer 130C on which the conductor patterns 190 are formed are prepared. The number of stacked resin layers is not limited to three layers, and for example, a greater number of resin layers may be used in the case where other wiring layers or radiation electrodes (passive elements and so on) are formed.

Through holes are formed in the parts of the resin layers where the transmission lines 140, which are interlayer connection conductors, are to be formed, and the through holes are filled with conductive paste. The through holes in the resin layer 130A are filled with conductive paste 145A, the through holes in the resin layer 130B are filled with conductive paste 145B, and the through holes in the resin layer 130C are filled with conductive paste 145C.

Figure 19B:
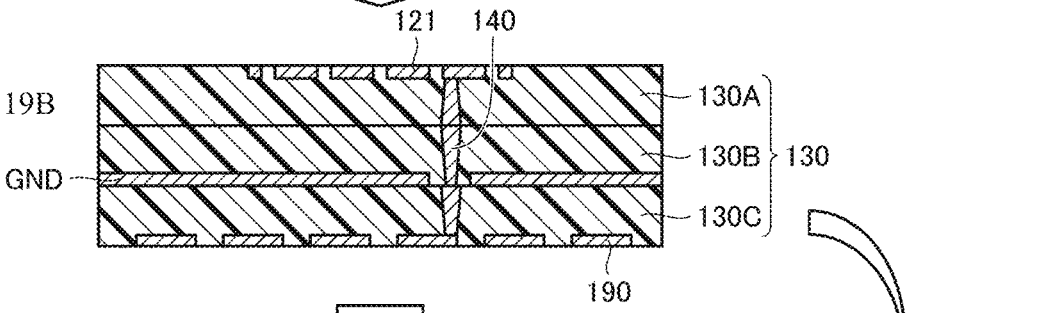

Next, the resin layers 130A to 130C are stacked on top of one another, and the layers are joined together by pressing the layers in the stacking direction while heating the layers at the softening temperature of the thermoplastic resin or higher (FIG. 19B). The thermoplastic resin also acts as an adhesive for connecting the layers together.

The electrodes such as the radiation electrodes 121 and the conductor patterns 190 become embedded inside the resin layers when the pressure bonding is performed due to softening of the resin. At this time, if openings have been formed in the conductor patterns, the insides of these openings are also filled with resin, and consequently the contact area between the resin layers and the conductor patterns is increased compared with a case where there are no openings and thus the adhesion strength is increased.

In addition, the conductive pastes 145A to 145C filling the through holes of the resin layers are hardened upon being heated, and interlayer connection conductors (transmission lines 140) are formed by the added metal (e.g., Sn) contained in the conductive pastes.

Figure 19C:
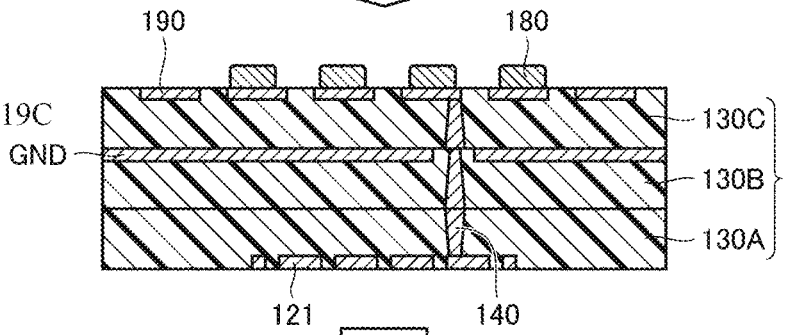
Figure 19D:
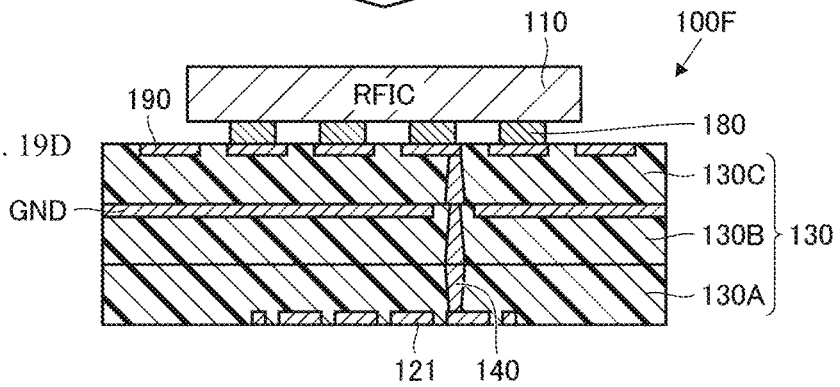

Once the resin layers are joined together, the dielectric substrate 130 is turned upside down and solder paste 180 is applied to the required locations on the conductor patterns 190 (FIG. 19C). After that, the RFIC 110 and the dielectric substrate 130 are connected to each other by arranging the RFIC 110 and then performing a reflow process (FIG. 19D). As a result of the reflow process, the antenna module 100F is formed.

During the heating and pressure bonding processes performed on the resin layers illustrated in FIG. 19B, some of the conductive paste evaporates and gas is generated. The generated gas basically passes through the inside of the substrate and is released to the outside, but the gas is unable to pass through the substrate in the parts where the conductor patterns are formed, and therefore the gas may accumulate at the interfaces between the conductor patterns and the resin layers and may cause parts of the conductor patterns to peel off.

When this state occurs, the bonding strength between the resin layers and the conductor patterns is reduced and variations occur in capacitance components in the regions where the peeling off has occurred and this can result in the impedance of the substrate as a whole being changed. For components that handle radio-frequency signals such as antenna modules, such a change in impedance will have an effect on the characteristics of the component.

In FIG. 19D, the reflow process is performed, but because the temperature used during the reflow process is generally higher than the heating temperature used in the heating and pressure bonding processes (i.e., the softening temperature of the thermoplastic resin), the heat applied to the regions around the conductor patterns 190 during the reflow process may also cause gas to be generated from the inside of the dielectric substrate 130.

Openings are formed as required in the radiation electrodes 121, the ground electrode GND, and the conductor patterns 190 corresponding to the above conductor patterns in the antenna module of this embodiment. Gas components that reach the interfaces between the conductor patterns and the resin layer pass through the openings and are released to the outside of the substrate. Therefore, it is possible to suppress the reductions in strength and the changes in impedance caused by peeling off of conductor patterns resulting from the gas being generated inside the substrate during heating.

Prior to performing the process of mounting the RFIC 100 as described above, a protective film 200 may be formed on the mounting surface (second surface 134) of the dielectric substrate 130, as illustrated in FIG. 20. An opening is formed in the protective film, and the electrode pads 190B, which are exposed from the opening, are formed (over resist). At this time, the entire surface of the conductor pattern 190A is covered with the protective film 200.

In this case, if openings are formed in the conductor pattern 190A, gas that passes through the openings may accumulate at the interface between the protective film 200 and the dielectric substrate 130, and this in turn may cause the protective film 200 to peel off. Therefore, it is preferable that openings be not formed in parts of the conductor patterns directly below the protective film 200. In the example in FIG. 18 described above, since an external device is not connected to the conductor pattern 190A arranged along the outer periphery, the conductor pattern is entirely covered with the protective film 200 when the protective film 200 is formed. Therefore, openings are not formed in the conductor pattern 190A in FIG. 18.

Furthermore, the connection portions of the RFIC 110 in the antenna module may be subjected to a sealing process using an underfill agent 210, as illustrated in FIG. 21. The underfill agent 210 is a curable liquid resin containing, for example, epoxy or silicone. By performing the sealing process using the underfill agent 210, the strength of the connection parts between the protective film 200 and the dielectric substrate 130 or the connection parts of the solder bumps 180 can be improved. Not only the connection parts of the RFIC 110 but also the entire RFIC 110 may be sealed (sealing process) using resin.

In general, since the temperature used in the sealing process is lower than the temperature at the time of the heating and pressure bonding processes and the reflow process, the sealing process produces little or no further gas from the inside of the dielectric substrate 130.

(Application to Flexible Substrate)

Improvement of adhesion strength between electrodes and a substrate by forming openings in mounting electrodes is not limited to connection parts between an RFIC and electrode pads. For example, this improvement method can also be applied to parts that are prone to stress such as the connection parts of the connectors in an antenna module using a flexible substrate, as illustrated in FIG. 22.

A communication device 10A in FIG. 22 is structured such that an antenna device 105 is attached to a mounting substrate 20 on which the RFIC 110 is mounted via connectors 30 and 35.

The antenna device 105 includes a flexible substrate 135, the dielectric substrate 130, the radiation electrodes 121, and the transmission lines 140. The flexible substrate 135 is for example an LCP substrate having a multilayer structure. The radiation electrodes 121 are arranged at one end of the flexible substrate 135 with the dielectric substrate 130 interposed therebetween, and the connector 30 is attached to the other end of the flexible substrate 135. The connector 30 is bonded to conductor patterns (electrode pads) 190C formed on the flexible substrate 135 using solder and is configured to engage with the connector 35 arranged on the mounting substrate 20.

The flexible substrate 135 is bent in the middle of the substrate so that a direction normal to a first part of the substrate where the connector 30 is arranged and a direction normal to a second part of the substrate where the radiation electrodes 121 are arranged are roughly perpendicular to each other. Ground electrodes GND are formed on both main surfaces of the flexible substrate 135, and transmission lines 140 are formed inside the flexible substrate 135 to transmit radio-frequency signals from the RFIC 110 to the radiation electrodes 121. In other words, the flexible substrate 135 forms striplines. The connector 30 arranged on the flexible substrate 135 engages with the connector 35 arranged on the mounting substrate 20, and thereby radio-frequency signals are transmitted from the RFIC 110 to the radiation electrodes 121.

The radiation electrodes 121 are arranged so as to face a resin portion 16 formed in a metal casing 15 of the communication device 10A. The radiation electrodes 121 in FIG. 22 are arranged on the outer surface of the dielectric substrate 130, but may instead be embedded in the dielectric substrate 130, as in FIG. 16 and so on. Furthermore, openings may be formed in the radiation electrodes 121. Radio waves from the radiation electrodes 121 are radiated to the outside of the communication device 10A via the resin portion 16.

Due to the structure of the antenna device 105, which has the form of a cantilever beam, a mechanical load such as a bending stress is likely act on the part where the connector 30 is arranged and this may cause the electrode pads 190C to peel off from the flexible substrate 135. Therefore, peeling off of the electrode pads 190C caused by a mechanical load can be suppressed by forming openings in the electrodes pad 190C in order to increase the adhesion strength between the flexible substrate 135 and the electrode pads 190C.

Openings may also be formed in the transmission lines 140 or ground electrodes GND in order to increase the adhesion strength.

On the mounting substrate 20 side, openings may also be formed in conductor patterns (electrode pads) 190D for connecting the connector 35 and conductor patterns (electrode pads) 190E for connecting the RFIC 110 in order to increase the adhesion strength.

The presently disclosed embodiments are illustrative in all points and should not be considered as limiting. The scope of the present disclosure is not defined by the above description of the embodiments but rather by the scope of the claims, and it is intended that equivalents to the scope of the claims and all modifications within the scope of the claims be included within the scope of the disclosure.

10, 10A communication device,
15 casing,
16 resin portion,
20 mounting substrate,
30, 35 connector,
100, 100A, 100A1, 100A2, 100B to 100F, 100X antenna module,
105 antenna device,
111A to 111D, 113A to 113D, 117 switch,
112AR to 112DR low-noise amplifier,
112AT to 112DT power amplifier,
114A to 114D attenuator,
115A to 115D phase shifter,
116 signal multiplexer/demultiplexer,
118 mixer,
119 amplification circuit,
120 antenna array,
121, 121B, 121D, 121E, 121X, 121Y radiation electrode,
122, 150, 195 opening,
130 dielectric substrate,
130A to 130C resin layer,
132 first surface,
134 second surface,
135 flexible substrate,
140 transmission line,
145A to 145C conductive paste,
160 space,
170 metal fitting,
180 solder,
190, 190A to 190E conductor pattern,
200 protective film,
210 underfill agent,
GND, GND2 ground electrode,
SP1, SP1A, SP2, SP2A feed point.

The invention claimed is:

1. An antenna module comprising:
a dielectric substrate; and
a radiation electrode and a ground electrode arranged on or in the dielectric substrate;
wherein a plurality of openings are provided in at least one electrode of the radiation electrode and the ground electrode, the plurality of openings penetrating through the at least one electrode and not penetrating through the dielectric substrate,
wherein the radiation electrode includes a first feed point and a second feed point to which radio-frequency power is supplied, and
in a plan view in a direction normal to the antenna module, the plurality of openings are provided inside a prescribed region including a first line connecting the first feed point and the second feed point.

2. The antenna module according to claim 1, wherein the plurality of openings are provided uniformly and evenly spaced over the at least one electrode.

3. The antenna module according to claim 2, wherein the plurality of openings are at least partially filled with a dielectric material of the dielectric substrate.

4. The antenna module according to claim 2, wherein the plurality of openings are provided in the radiation electrode.

5. The antenna module according to claim 1,
wherein in the plan view in the direction normal to the antenna module, the radiation electrode has a circular or regular polygonal flat plate shape, and
the plurality of openings are provided along a second line passing through a center of the radiation electrode and intersecting with the first line.

6. The antenna module according to claim 5,
wherein the radiation electrode further includes a third feed point and a fourth feed point to which radio-frequency power is supplied, and
in the plan view in the direction normal to the antenna module, the plurality of openings are also provided along a fourth line passing through the center of the radiation electrode and intersecting with a third line connecting the third feed point and the fourth feed point.

7. The antenna module according to claim 6, wherein the plurality of openings are at least partially filled with a dielectric material of the dielectric substrate.

8. The antenna module according to claim 6, wherein the plurality of openings are provided in the radiation electrode.

9. The antenna module according to claim 5, wherein the plurality of openings are at least partially filled with a dielectric material of the dielectric substrate.

10. The antenna module according to claim 5, wherein the plurality of openings are provided in the radiation electrode.

11. The antenna module according to claim 1, wherein the plurality of openings are at least partially filled with a dielectric material of the dielectric substrate.

12. The antenna module according to claim 11, wherein the plurality of openings are provided in the radiation electrode.

13. The antenna module according to claim 1, wherein the plurality of openings are provided in the radiation electrode.

14. The antenna module according to claim 1, wherein the plurality of openings are provided in the ground electrode.

15. The antenna module according to claim 1, further comprising:

a feeder circuit mounted on the dielectric substrate and configured to supply radio-frequency power to the radiation electrode.

16. The antenna module according to claim 15, further comprising:

a connection electrode for mounting the feeder circuit on the dielectric substrate, another opening being provided in the connection electrode, the other opening penetrating through the at least one electrode.

17. A communication device in which the antenna module according to claim 1 is mounted.

18. The antenna module according to claim 1, wherein the first feed point and the second feed point are on the radiation electrode.

19. The antenna module according to claim 1, wherein the first feed point and the second feed point are configured to be independently supplied with radio-frequency power.

* * * * *